US005709479A

United States Patent [19]

Bell

[11] Patent Number: 5,709,479

[45] Date of Patent: Jan. 20, 1998

[54] BAG CONSTRUCTION FOR DISTRIBUTING MATERIAL

[75] Inventor: Gary M. Bell, Crystal, Minn.

[73] Assignee: Kapak Corp., St. Louis Park, Minn.

[21] Appl. No.: 709,163

[22] Filed: Sep. 6, 1996

[51] Int. Cl.[6] ..... B65D 30/10

[52] U.S. Cl. ..... 383/209; 383/10; 383/61; 383/63; 383/67; 383/120; 383/204; 383/906

[58] Field of Search ..... 383/10, 203, 204, 383/208, 209, 41, 61, 63, 67, 210, 211, 100, 120, 906, 102, 103

[56] References Cited

U.S. PATENT DOCUMENTS

| | | | |
|---|---|---|---|
| 383,327 | 5/1888 | Starr . | |
| 2,001,149 | 5/1935 | Monschein . | |
| 2,163,324 | 6/1939 | Reinhold . | |
| 2,390,822 | 12/1945 | Wren | 383/211 X |
| 2,442,646 | 6/1948 | Fields | 383/906 X |
| 2,865,768 | 12/1958 | Barnes et al. . | |
| 3,159,096 | 12/1964 | Tocker . | |
| 3,174,644 | 3/1965 | Kaltman et al. | 383/67 X |
| 3,229,813 | 1/1966 | Crowe, Jr. et al. . | |
| 3,456,867 | 7/1969 | Repko | 383/61 X |
| 3,469,768 | 9/1969 | Repko | 383/906 X |
| 3,741,778 | 6/1973 | Rowe . | |
| 3,807,118 | 4/1974 | Pike | 383/61 X |
| 3,827,341 | 8/1974 | Stage . | |
| 3,980,225 | 9/1976 | Kan . | |
| 3,991,801 | 11/1976 | Ausnit | 383/61 |
| 4,000,846 | 1/1977 | Gilbert . | |
| 4,191,230 | 3/1980 | Ausnit | 383/61 |
| 4,206,870 | 6/1980 | De Vries . | |
| 4,526,565 | 7/1985 | Hummel et al. . | |
| 4,532,652 | 7/1985 | Herrington . | |
| 4,553,693 | 11/1985 | Terajima et al. . | |
| 4,576,316 | 3/1986 | Foster . | |
| 4,741,909 | 5/1988 | Guthrie . | |
| 4,913,693 | 4/1990 | Ball et al. . | |
| 5,035,516 | 7/1991 | Pacheco . | |
| 5,059,036 | 10/1991 | Richison et al. . | |
| 5,080,155 | 1/1992 | Crozier . | |

FOREIGN PATENT DOCUMENTS

| | | | |
|---|---|---|---|
| 230565 | 12/1963 | Austria | 383/103 |
| 0 345 930 | 12/1989 | European Pat. Off. . | |
| 0 537 109 A2 | 9/1991 | European Pat. Off. . | |
| 22 65 145 | 9/1973 | Germany . | |
| 2933-151 | 2/1981 | Germany . | |
| 2-4651 | 1/1990 | Japan . | |
| 3-133747 | 6/1991 | Japan . | |
| 1 204 462 | 9/1970 | United Kingdom . | |
| 9400363 | 1/1994 | WIPO | 383/67 |

*Primary Examiner*—Jes F. Pascua
*Attorney, Agent, or Firm*—Merchant, Gould, Smith, Edell, Welter & Schmidt

[57] ABSTRACT

A bag construction for use to distribute flowable material is provided. The bag construction generally includes first and second panels or panel sections oriented juxtaposed to one another. In one end of the bag construction, a base gusset is provided between the panels. The base gusset includes apertures therein, for distribution of flowable materials. In preferred embodiments, a rib-and-trough closure arrangement is provided so that the pouch construction can be selectively closed to inhibit distribution of material, when desired. Methods of preparing such arrangements and methods of use are provided.

20 Claims, 7 Drawing Sheets

BAG CONSTRUCTION FOR DISTRIBUTING MATERIAL

FIELD OF THE INVENTION

The present invention relates to bag or pouch constructions. In particular it relates to an arrangement from which powdered or particulate material can be readily distributed, conveniently, by a user. The invention also concerns methods for preparing such arrangements and methods of using such arrangements.

BACKGROUND OF THE INVENTION

A wide variety of items comprise materials which, in use, are dispersed or spread over an area. Many of these items are dry powder or particulate materials. Examples of these include: grass seed; plant nutrients; insect dust; and colored chalk.

In use, such materials are generally dispersed over some surface. For those materials that are dispersed over the ground or plants, sometimes mechanical spreading equipment is used. While the equipment can be quite effective, it is often large, bulky, and is generally only desirable if a relatively large amount of material is to be spread over a relatively large area.

In many instances mechanical spreading equipment is not appropriate. In addition, mechanical spreading equipment may need to be thoroughly cleaned between uses, which can be inconvenient.

In some instances, spreading has involved either hand spreading or spreading with a hand-held scoop of some type. This can be inconvenient and messy.

Alternate arrangements for spreading materials have been desirable.

SUMMARY OF THE INVENTION

According to the present invention, a bag arrangement or construction is provided. The bag construction includes first and second opposed or juxtaposed panels or panel sections. In the preferred embodiments shown, each of the panel sections has a first end edge, a second end edge, and opposite side edge portions extending between the first and second end edges and in extension from the first end edge to the second end edge of each panel section. The panel sections are secured to one another along at least a portion of the panel section side edge portions, to form a pouch construction having an interior and side edges. Preferably the side edges comprise seals, most preferably heat seals.

The bag construction includes a base gusset member. The base gusset member is oriented in extension between the first and second panel sections and transversely across an end of the pouch construction interior. Herein when it is said that a feature extends "transversely" across the bag construction and/or at least one of the panels, it is meant that the direction of extension is from one of the side edges of the panels or bag construction to the other, rather than from one end edge to the other.

In arrangements according to the present invention, the base gusset member includes distribution apertures therein. For example, the base gusset member may include a plurality of holes or slits therein, to allow flowable material to pass therethrough, selectively, in use.

In certain preferred embodiments, the base gusset distribution apertures comprise holes having an average diameter within the range of about 0.1865 inch, and the gusset member comprises a material having an average population density of the holes of about 8 per square inch.

A variety of materials may be utilized for bag constructions according to the present invention. Certain preferred plastic materials, with heat sealant material thereon, are usable, as described herein.

In certain preferred constructions, the bag construction includes a first transverse seal securing the first and second panel sections together, the first transverse seal being oriented between the base gusset member and the first end edges of the first and second panel sections. When it is said in this context that the transverse seal is "between" the first end edges and the first and second panel sections, it is meant that the seal is located in this region, even though it extends transversely across the bag and does not extend from the gusset member to the first end edges. In operation the first transverse seal forms a pouch interior bordered by the base gusset member, the transverse seal, and the side edges of the bag construction.

Preferred arrangements according to the present invention that include a first transverse seal as defined, also include at least one handle aperture oriented between the first transverse seal and the first end edges of the first and second panel sections to form a handle member. The handle member, if positioned at this location, can be easily grasped for operation of the arrangement to distribute particulate material.

In certain preferred embodiments the bag construction includes a first transverse openable and reclosable closure arrangement, in extension between the first and second panel sections, that is oriented to close the bag arrangement by securing the first and second panel sections to one another, in a releasable and reclosable manner. The first transverse openable and reclosable arrangement is preferably oriented to extend transversely across the bag arrangement at a location oriented between the base gusset member and the second end edges of the first and second panel sections. Thus, the first closure construction can be used to selectively close the bag arrangement at a location on an opposite side of the gusset member, from the interior of the pouch. This is a location oriented underneath the gusset member, when the bag construction is oriented as it normally would be for use to distribute material.

Preferably the transverse openable and reclosable closure arrangement comprises a rib-and-trough closure arrangement, sometimes referred to as a zipper-type closure arrangement.

In certain arrangements, preferably the bag construction includes a transverse end seal, sealing the first and second panel sections to one other along the second end edges of the panel sections. These end edges would be the end edges normally located underneath the gusset member, when the bag construction is oriented in its normal upright position. Alternately stated, these end edges are the end edges located on an opposite side of the base gusset member from the portion of the pouch interior in which flowable particulate material is normally stored before distribution.

Preferably arrangements according to the present invention include a weakened transverse tear line portion extending transversely across the bag construction and oriented at a location between the first transverse openable and reclosable closure arrangement and the transverse end seal. In this manner, a tab including the transverse end seal could be readily torn from the arrangement, exposing the base gusset member and the openable and reclosable closure arrangement for selective operation in a preferred manner to distribute material. In certain arrangements, preferably the transverse tear line is a score line in at least one of the panel sections. Alternatively, in certain arrangements preferably the transverse tear line is a perforated tear line in at least one of the panel sections. In certain preferred embodiments, tear notches are positioned at opposite ends of the tear line, to facilitate removal of the tearable tab from the arrangement, by hand.

According to certain embodiments of the present invention, an arrangement including flowable particulate material therein, to be dispersed, is provided. The flowable particulate material generally and preferably comprises material which has an average particle size sufficiently smaller than the average size of the perforations in the base gusset member, to facilitate distribution and flowing of the particulate material through the gusset member, in use. The term "flowable particulate material" in this context is intended to at least include pellets, grains, and powders. In some instances, arrangements according to the present invention may even be used to dispense liquids.

In certain embodiments of the present invention, as an alternative to having a transverse seal closing a top end of the pouch, i.e. sealing the first panel to the second panel at a location on the same side of the gusset member as the bag interior and generally between the base gusset member and top end edges or first end edges of the pouch, the construction includes an openable and reclosable closure arrangement at this location. An example of such an closure arrangement would be a rib-and-trough closure arrangement located at this position. Thus, in some embodiments, constructions according to the present invention can include more than one rib-and-trough closure arrangement.

The invention includes within its scope: empty pouch arrangements with an open top end to be filled with particulate material; pouch arrangements with particulate material filled and stored therein; pouch arrangements with a bottom tab portion torn therefrom; pouch arrangements which have been opened along a base gusset after a tab has been torn therefrom, for distribution of particulate material; methods of distributing particulate material utilizing such pouch arrangements; and, methods of preparation of such pouch arrangements.

In the detailed descriptions, discussions of each of these items are provided.

DETAILED DESCRIPTION OF TEE PREFERRED EMBODIMENT

Figure 1:
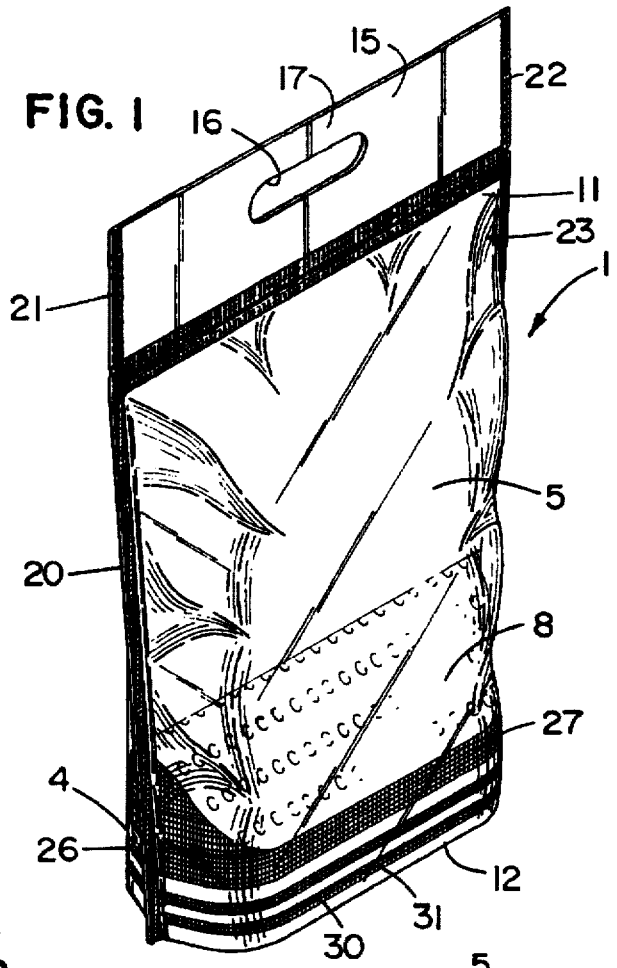
FIG. 1 is a perspective view of a bag arrangement according to the present invention shown with a bottom end in an open position for spreading and positioned in a stand-up orientation.
Figure 2:
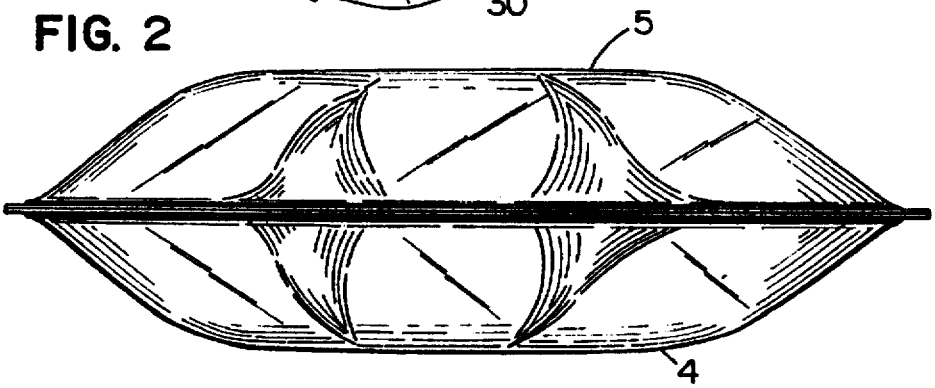
FIG. 2 is a top plan view of the bag arrangement shown in FIG. 1.

The reference numeral 1, FIG. 1, generally designates a bag construction or pouch arrangement according to the present invention. The particular arrangement 1 illustrated in the FIGS. 1–10, is shown as if prepared from substantially transparent materials. In this manner internal detail can be readily seen. From descriptions below with respect to usable materials, it will be apparent that non-transparent materials may be utilized for constructions according to the present invention.

Referring still to FIG. 1, the bag construction 1 depicted in FIG. 1 is illustrated as it would generally appear when selectively opened and oriented for use, in a process of distributing or dispersing material. The arrangement shown in FIG. 1, however, is depicted without any material loaded therein for distribution, to facilitate viewing of internal detail. Positioning of material to be distributed will be apparent from descriptions below.

Figure 3:
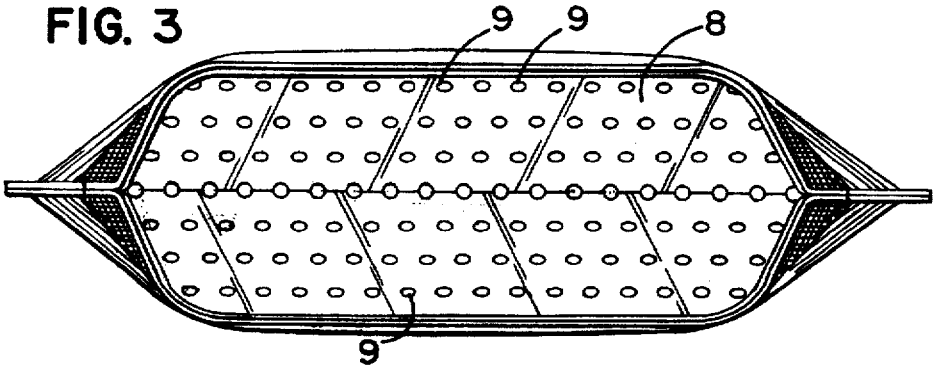
FIG. 3 is a bottom plan view of the bag arrangement shown in FIG. 1.

Still referring to FIG. 1, bag construction 1 comprises first and second, opposed, side walls, panel sections or panels 4 and 5; and, base or bottom gusset or gusset member 8. The bottom gusset 8, FIG. 3, is perforated, as illustrated by distribution apertures or holes 9. Holes 9 are appropriately sized, and there is a selected amount of holes 9 per unit area in gusset 8, to allow for desirable passage of particulate or powdered material therethrough to facilitate distribution.

Referring again to FIG. 1, bag construction 1, as oriented and depicted in FIG. 1, has a first closed (top) end 11 and a second, opposite, open (bottom) end 12. In the particular embodiment shown, closed end 11 includes an upper flap 15 thereon with a handle aperture 16 therein.

A typical operation of arrangement 1 will be apparent from review of FIG. 1. In use, the user holds construction 1 by handle 17. With bottom end 12 open, if the user shakes the bag construction 1, flowable particulate material (for example pellets, grains or powders) within bag construction 1 will be dispensed through bottom gusset 8, i.e. through apertures 9, and will be distributed out of the open end 12. The user can readily control distribution, by simply orienting the arrangement 1 above the object or area over which distribution of the particulate material is desired, and shaking the bag 1 appropriately.

Still referring to FIG. 1, in general side panels 4 and 5 are secured, and preferably sealed, to one another along seams or seals 20,21,22,23 and 24. These seals, in preferred arrangements, comprise heat seals. They may be formed in a manner conventional for pouch constructions.

Still referring to FIG. 1, in regions 26 and 27, gusset 8 is secured to panels 4 and 5, respectively. Again, the areas of attachment may comprise heat seals in preferred arrangements. The seals may be conventional, for the formation of stand-up pouch constructions, such as those illustrated in U.S. Pat. Nos. 5,059,036; 5,147,272; and 5,254,073, incorporated herein by reference.

Still referring to FIG. 1, the arrangement 1 depicted includes an openable and reclosable closure arrangement 30, for selective opening and closing of end 12. In the particular arrangement shown, closure 30 comprises a rib-and-trough or zipper-type closure mechanism 31, wherein a secure closure is obtained by pressing a rib into a trough, thereby securing the two panel sections 4, 5 to one another. Such arrangements are available under the trademark Ziploc® from Dowbrands, L.P. The closure arrangement 30 may be secured in bag arrangement 1 by a variety of appropriate means, for example by heat sealing, with an adhesive, or in other convenient manners.

From review of FIGS. 1 and 3, it will be apparent that after the user has distributed a desired amount of particulate material within construction 1, through gusset 8, the arrangement can be closed through use of closure 30. Of course it can be reopened, by selective opening of closure arrangement 30, when further use to dispense material is desired.

Attention is now directed to FIGS. 4–8. From a review of these figures, further regarding assembly and operation of arrangements such as arrangement 1 will be understood.

Figure 4:
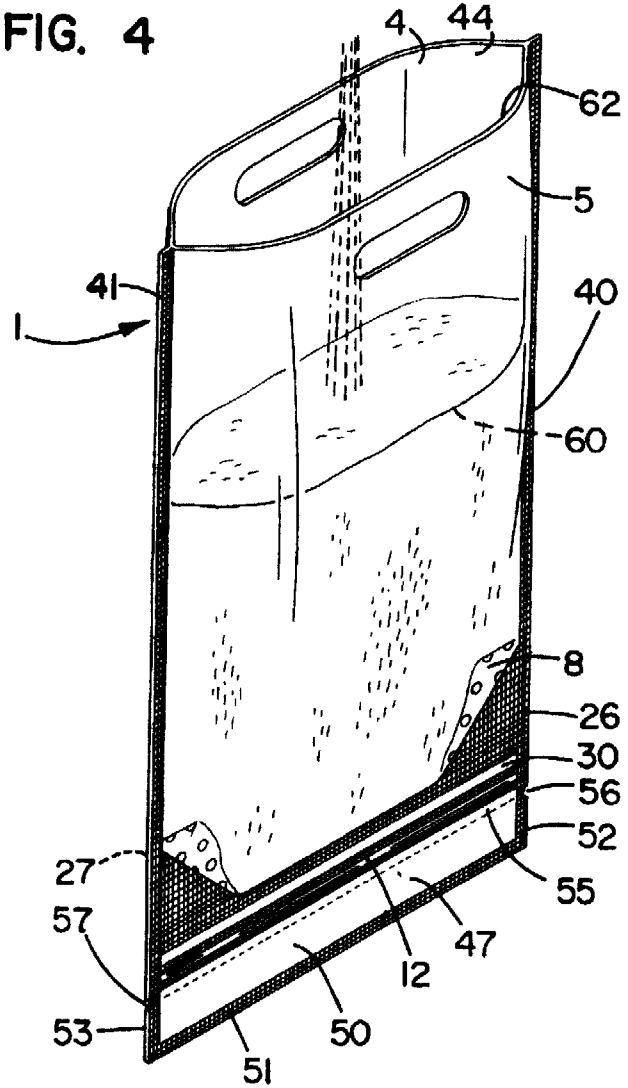
FIG. 4 is a perspective view of a pouch from which the bag arrangement of FIG. 1 is formed, illustrated during filling.

Referring to FIG. 4, bag arrangement 1 is depicted as it could appear when being filled with particulate material for use. The front and back panels 5 and 4 are shown secured to one another along side seals 40 and 41. Seals 40 and 41 will, in the finished arrangement, form seals 20, 21, 22 and 23, FIG. 1. Gusset 8 is shown positioned between panels 4 and 5, and is secured in position at regions 26 and 27. Closure 30 is shown positioned appropriately at end 12.

In general, panels 4 and 5 define internal pouch or bag volume 44, generally defined by seal 24, base gusset 8 and the side edges along regions 20 and 23. In general, closure 30 is used to close end 12 in volume 44 at a location "underneath" gusset 8, when construction 1 is oriented in its "upright" or "use" orientation, FIG. 1.

On a side 47 of closure 30 opposite from internal volume 44, panels 4 and 5 define a lower tab 50, sealed at end seal 51 and side seals 52 and 53. The construction 1 preferably includes a weakened transverse tear line, to facilitate removal of tab 50, when desired. For the particular arrangement 1 depicted, in panel 4, a score line or perforated line 55 extends transversely across tab 50 from side 52 to side 53. Construction 1 also includes side notches 56 and 57 oriented in alignment with perforated (perf) line or score line 55.

For the preferred embodiment, perf line 55 comprises perforations or scores through panel 4 but not panel 5. However, alternate arrangements are operable.

In general, tab 50 should be sized appropriately, and perf line 55 should be oriented and sized appropriately, so that tab 50 can be readily torn from arrangement 1 by hand. Advantages from this will be apparent from further descriptions.

Still referring to FIG. 4, particulate material 60 is shown being loaded into arrangement 1 through open top end 62. The particulate material 60 may comprise, for example, grass seed or a plant nutrient. After the filling operation illustrated in FIG. 4, the arrangement will typically be sealed by a transverse seal 63 thereacross, to prevent the particulate material 60 from exiting the arrangement through open end 62. With respect to this, attention is directed to FIG. 5.

Figure 5:
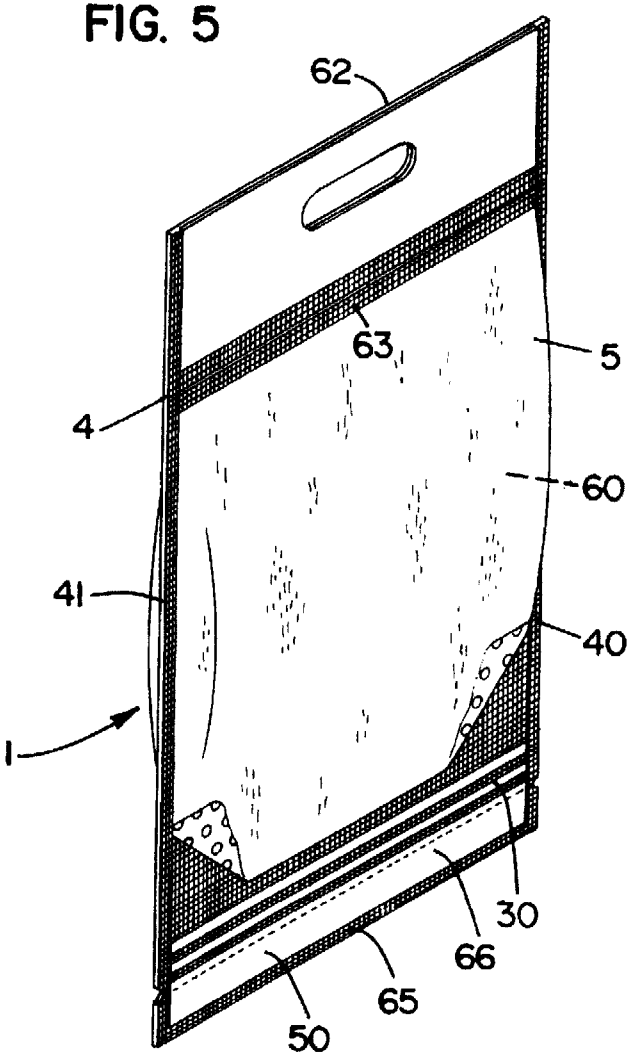
FIG. 5 is a perspective view of the arrangement shown in FIG. 4, after sealing a first or top end closed.

Referring to FIG. 5, arrangement 1 is depicted much as it would appear on a store shelf. Particulate material 60 is shown sealed within the arrangement 1. The tab 50 is depicted in place and has not yet been torn from the arrangement. End 62 is sealed closed by transverse seal 63, which secures panels 4 and 5 to one another at this location. For the particular arrangement 1 shown, seal 63 is a heat seal. The particulate material 60, then, is securely contained with the arrangement 1 between panels 5 and 4 and is retained by seals 40,41,63 and 65. In addition, closure arrangement 30 inhibits distribution of the particulate material into region 66 in tab 50.

Figure 6:
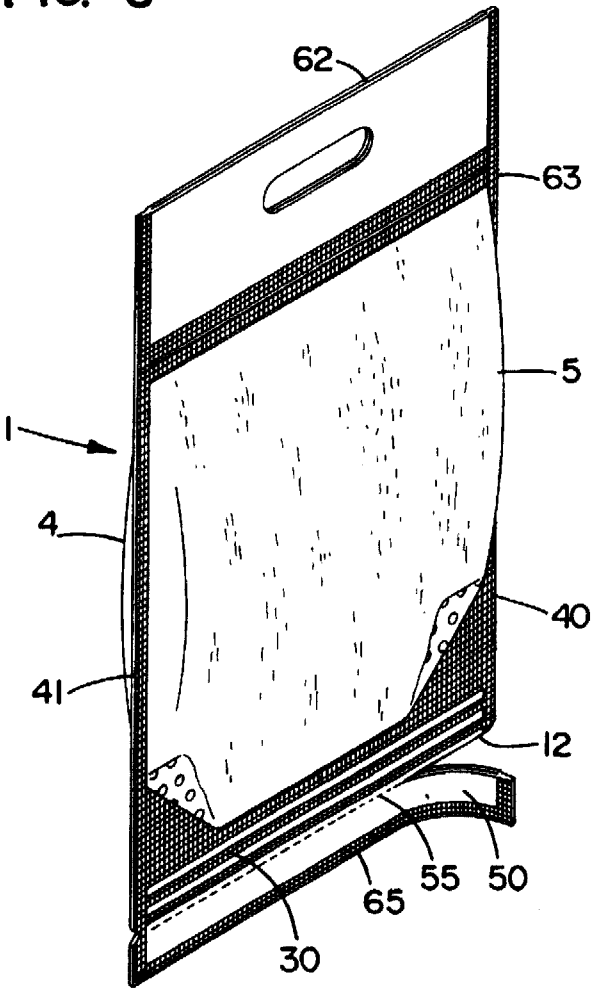
FIG. 6 is a perspective view of the arrangement shown in FIG. 5, during a step of tearing a tab off a second or bottom end.

Referring to FIG. 6, construction 1 is illustrated during a step of removing tab 50 therefrom, in order to allow for opening of end 12. Tab 50 is shown being torn from construction 1, along score line or perforated line 55.

Figure 7:
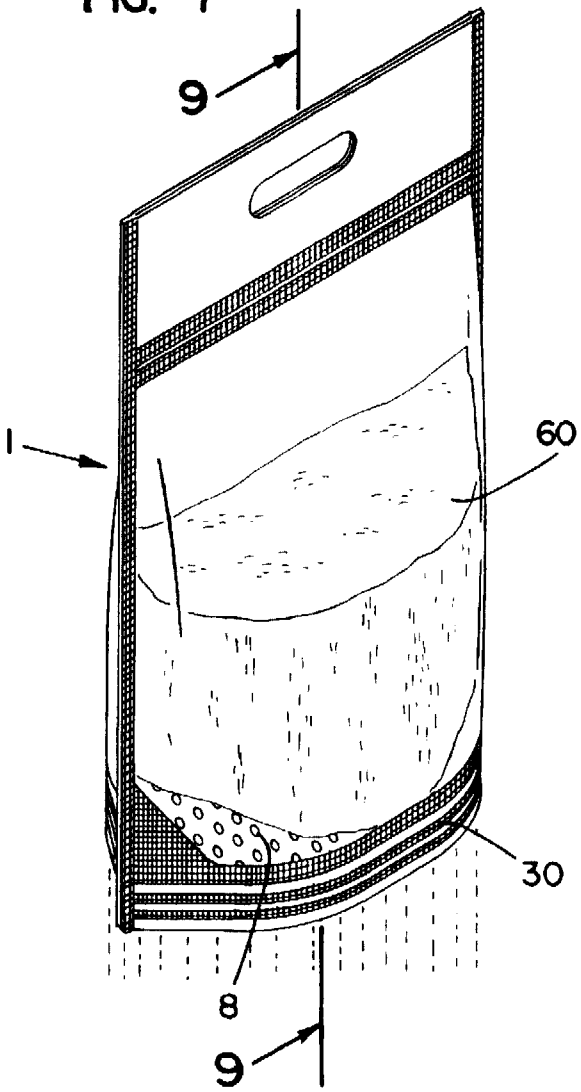
FIG. 7 is a perspective view of the arrangement shown in FIG. 5, after a step of tearing off a tab from a second end and opening the second or bottom end for spreading material.

Once tab 50 has been completely removed from the arrangement, the bag construction 1 may be selectively opened along closure arrangement 30, as illustrated in FIGS. 1 and 7. Referring to FIG. 7, particulate material 60 can now be distributed through gusset 8, since closure arrangement 30 is open. The distribution may be accomplished in the manner described above with respect to FIG. 1, i.e. by grasping of handle 16 and shaking.

Figure 8:
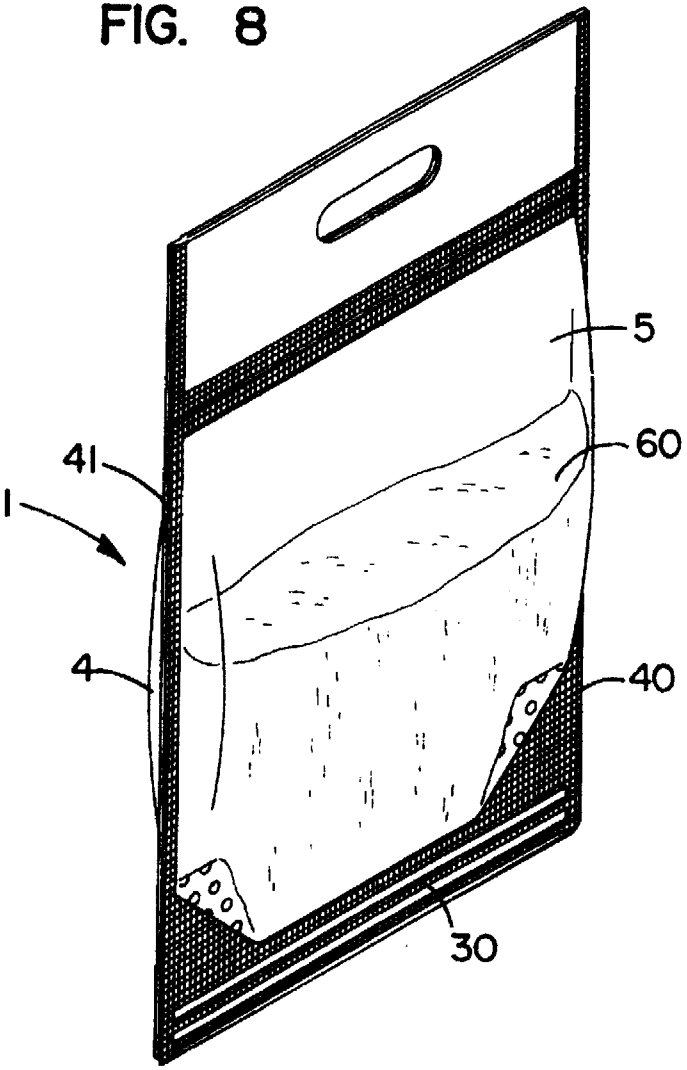
FIG. 8 is a perspective view of the arrangement shown in FIG. 7, after a step of reclosing a bottom end.

Referring to FIG. 8, after a selected amount of particulate material has been distributed, the arrangement can be readily reclosed by closure arrangement 30. Of course it can be reopened as desired, for further distribution of materials.

Figure 9:
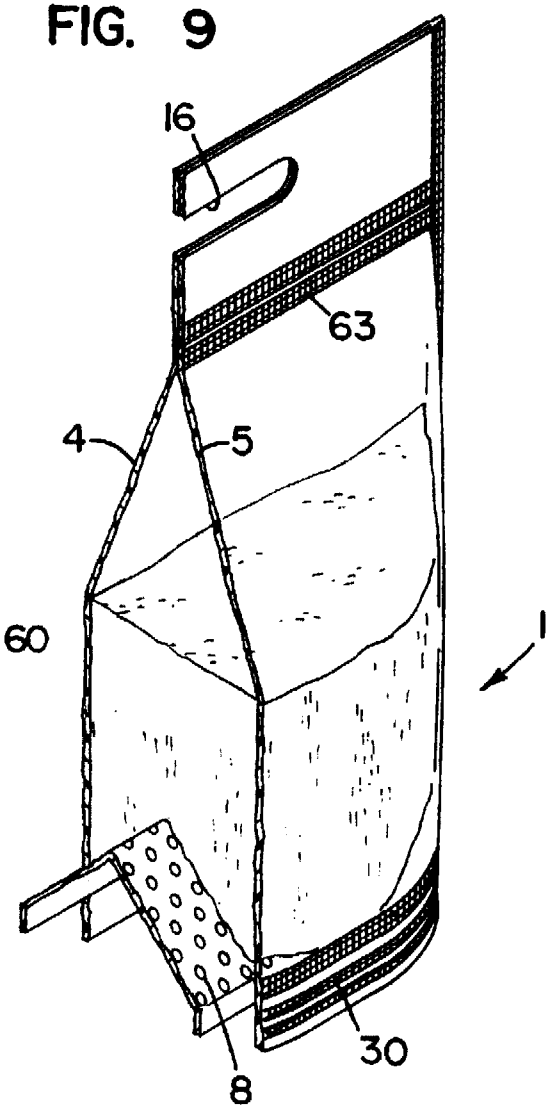
FIG. 9 is a perspective cross-sectional view taken generally along line 9—9, FIG. 7.

Attention is now directed to FIG. 9. In FIG. 9 a cross-section taken generally along line 9—9, FIG. 7, is depicted. In FIG. 9, the gusset 8 can be viewed positioned between panels 4 and 5.

Figure 10:
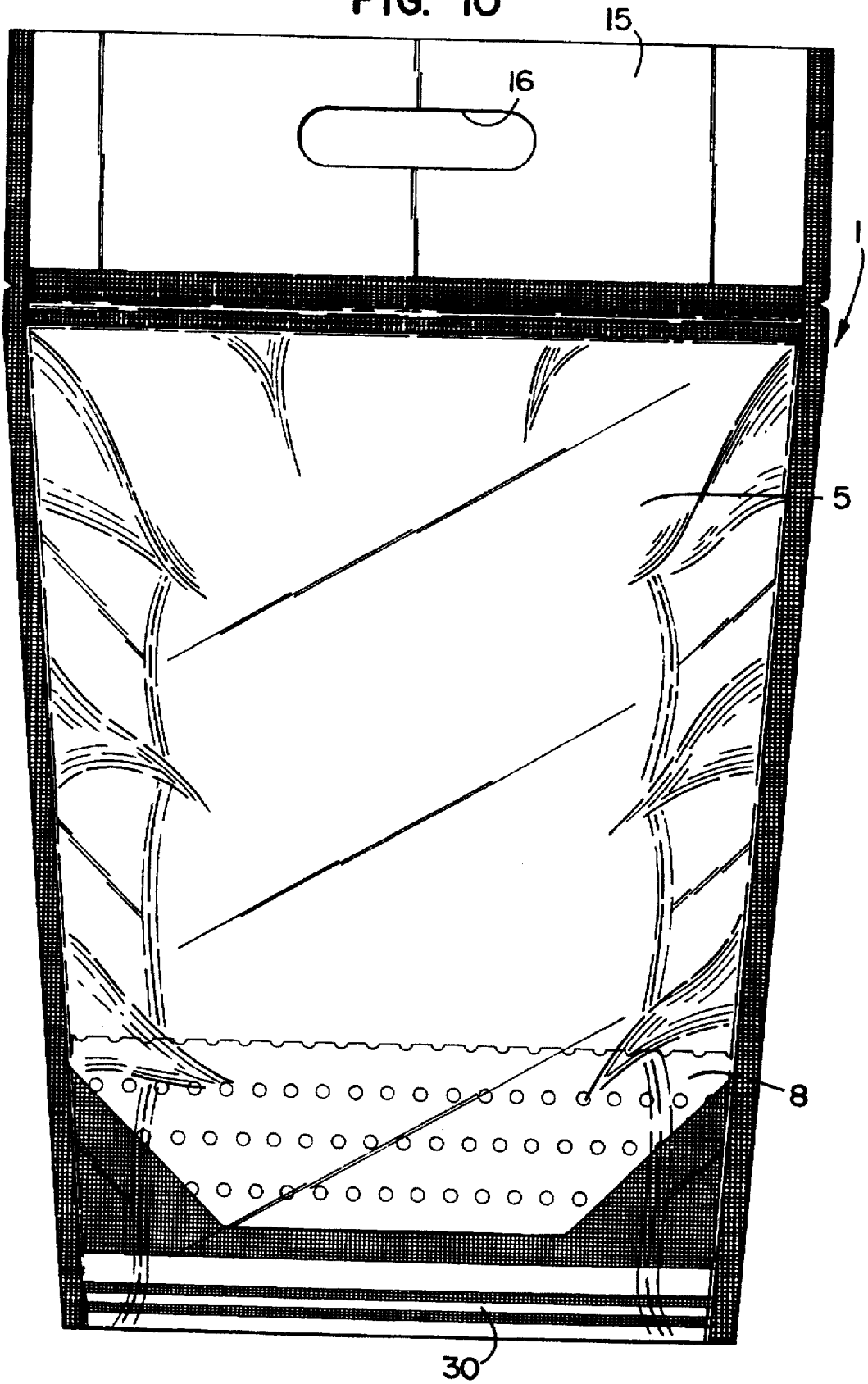
FIG. 10 is a front plan view of the arrangement shown in FIG. 1.
Figure 11:
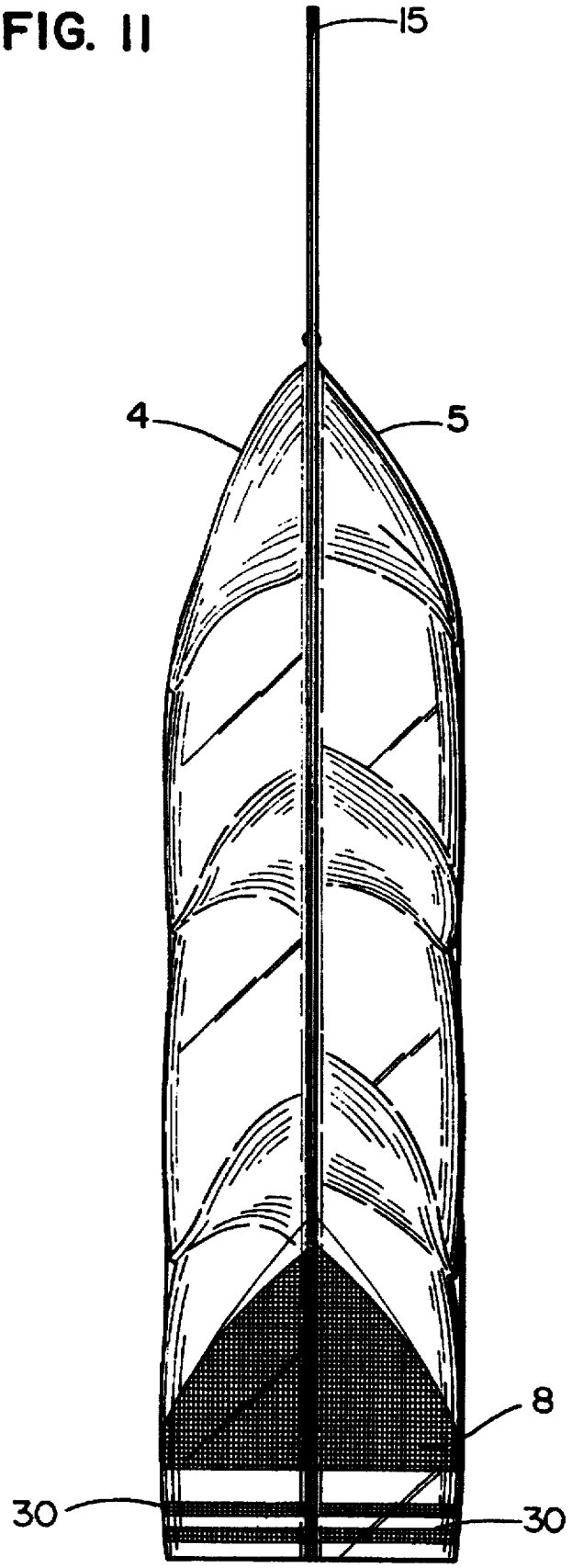
FIG. 11 is a side elevational view of the arrangement shown in FIGS. 1 and 10.

In FIGS. 10 and 11, a front elevational view and a side elevational view of construction 1, when opened and positioned for distribution of particulate material therein, are depicted.

Figure 12:
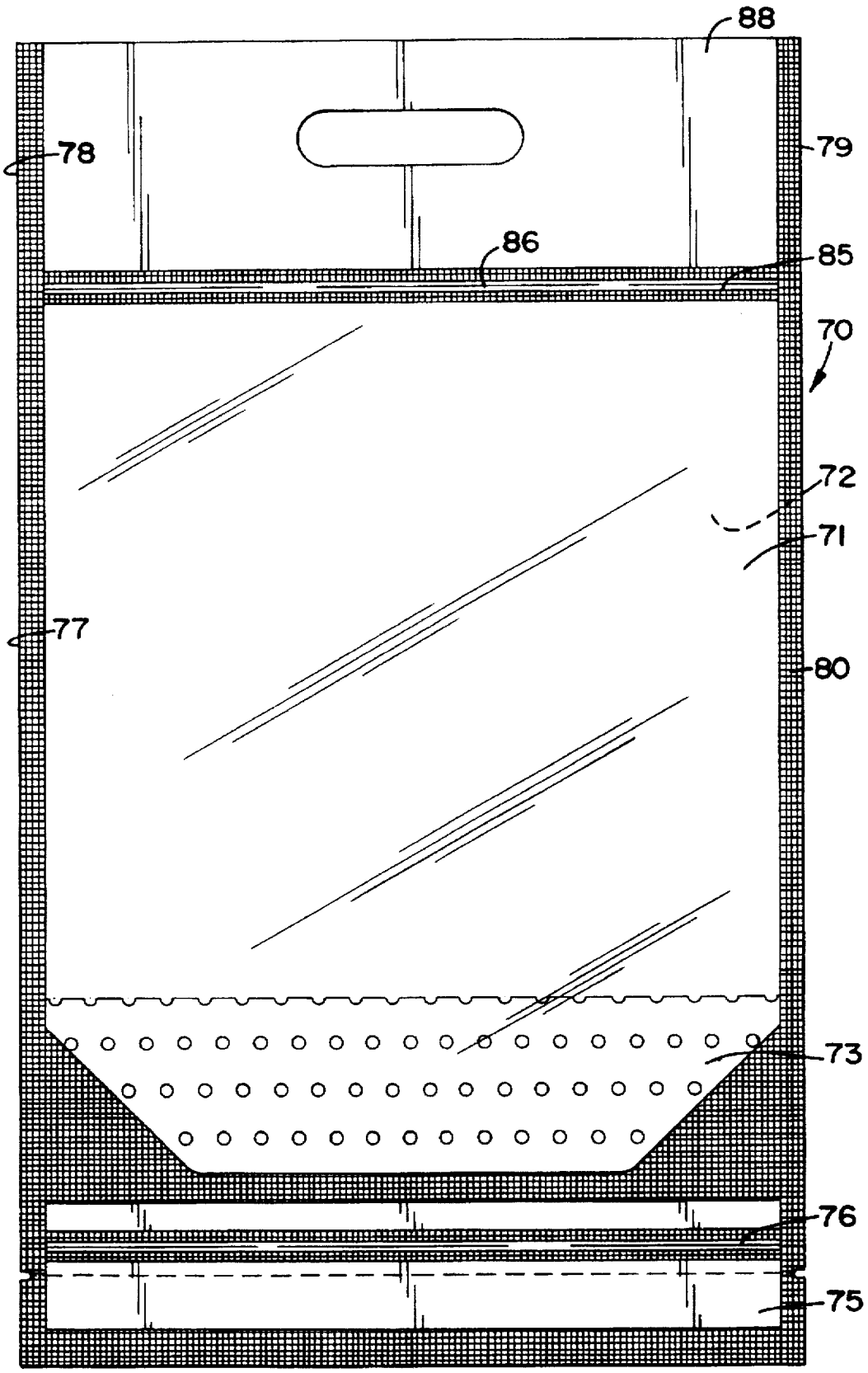
FIG. 12 is a top plan view of an alternate embodiment of the present invention.

Attention is now directed to FIG. 12. In FIG. 12 an alternate embodiment of a bag arrangement is illustrated generally at 70. Arrangement 70, FIG. 12, is generally analogous to arrangement 1, FIGS. 1–11, and comprises first and second opposite panels 71 and 72, and bottom gusset 73. The arrangement 70 includes removable tab 75; closure arrangement 76; and, edge seals 77,78,79 and 80.

In contrast to the arrangement of FIGS. 1–11, which included transverse top seal 63 therein, the arrangement 70, of FIG. 12, includes a second openable and resealable closure mechanism 85 in a top end 86 thereof, as a form of top seal. Closure mechanism 85 may comprise a conventional rib-and-trough closure arrangement 86, similar to the arrangement preferred for closure arrangement 30, FIGS. 1–11.

The arrangement of FIG. 12 is a construction which can be refilled by the user, periodically, for more than one use. That is, it can be operated in the same manner as the arrangement of FIGS. 1–11, for distribution of particulate material. In addition, periodically closure mechanism 85 can be selectively opened, to open top end 86. The user can then refill the bag arrangement 70, for example from a feed supply of material to be distributed, if desired.

Preparation of Arrangements

While a variety of means may be utilized to prepare arrangements according to FIGS. 1–12, herein a preferred convenient method is described. The general steps are described below.

According to the method, two webs of material, each preferably being of approximately the width and preferably continuous are provided. During the process, the two webs are brought together, in opposition to one another. It is these two webs, when cut in sections, that form the opposite panels, for example panels 4 and 5, FIG. 1 of the arrangement. In preferred applications, the longitudinal direction of the two webs, i.e. the continuous direction, will in general correspond to the transverse direction of the arrangement when completed.

In a follow-up step, the two webs are brought together in opposition, ultimately to comprise panel sections 4 and 5. During the step of bringing the webs together, a continuous strip of gusset material is preferably fed therebetween along an appropriate edge. The gusset material may be pre-punched to include the distribution apertures. Alternatively, the punching operation may take place after the trimming and sealing steps. A continuous strip comprising the closure arrangement, i.e. rib-and-trough closure means, is also fed between the panel sections.

In later steps of the process, a continuous composite which preferably comprises: a first web; a second web opposed to the first web; and, a continuous gusset web, with one or two closure arrangements depending on the embodiment involved, is cut, trimmed and sealed, preferably by heat sealing, into a pouch arrangement corresponding to the arrangement 1 of FIG. 1 with one end open, for example corresponding to end 4 FIG. 4.

In some applications, it may be desirable to form the two webs (to be brought together) from a single roll or web of material. This can be done, for example, by providing a primary web which is split in half, longitudinally, to form two webs. These webs can then be utilized as the two webs in the process.

A schematic illustrating the above methodology is illustrated in FIG. 9 of U.S. Pat. Nos. 5,059,036; 5,147,272; and 5,254,073, all of which are incorporated by reference herein. Of course, provisions are made for providing apertures in the base gusset material, for providing a carry handle, and for providing an additional seal in the region of the base gusset.

It is noted that Totani Giken Kegyo Co., Ltd. of Kyoto, Japan produces a pouch making machine under the designation BH-600S which can be utilized to form two panel pouches having a base gusset. Such an apparatus can be modified to provide for pouch arrangement according to the present invention, by including appropriate feeds for rib-and-trough closure arrangements and appropriate cutting and sealing equipment.

Pouch arrangements according to the present invention may be provided with a variety of outer dimensions, depending on the intended use. A particularly convenient arrangement has dimensions by 12 inches by 15.5 inches.

Pouch arrangements according to the present invention may be manufactured from a variety of materials. It is particularly advantageous, however, that they be constructed from relatively thin, strong material such as polyester biaxially oriented nylon linear low density polyethylene (PET/BON/LLDPE) film. Preferred embodiments which are particularly useful, and which include advantages according to the present invention, may be constructed wherein the first and second panel portions comprise first and second sheets of PET/BON/LLDPE 3-ply, each having a thickness within a range of about 7 mils. Similar material may be utilized for the base gusset (with appropriate apertures or slits therein). Preferably heat sealable film is utilized, so that the means for securing the panel portions to another, securing the closure means and panel portions, and securing the base gusset in place, is by heat seals without the need for additional adhesive.

The film materials are available in 3 substrates and are laminated together in a conventional adhesive lamination process. The polyester substrate has an adhesive applied, then the nylon substrate is applied. The polyester substrate and nylon substrate are laminated together. This resulting layer is coated with the linear low density polyethylene substrate, and then laminated together.

The first substrate, polyester, is available from DuPont. The second substrate, biaxially oriented nylon, is available from Allied Signal. The third substrate, linear low density polyethylene, is available from Consolidated Thermoplastics of Chippewa Falls, Wis.

For arrangements according to the present invention, the flowable material, when it is a particulate material, may be in a variety of forms including, for example pellets, grains, seeds or powders. In general the maximum average dimension of the flowable particulate material should be sufficiently smaller than the average size of the apertures in the base gusset member, to facilitate distribution, i.e. flow of the particulate material through the base gusset member when desired. A variety of pattern of holes or apertures in the base gusset member, shapes of such apertures, sizes of such apertures, and population density of distribution of such apertures may be used. In general, for typical preferred embodiments, it is foreseen that round apertures of about 0.1865 inch in diameter will be useful for many application, such as for example distribution of grass seeds or small granular material. In such constructions generally the base gusset material will be formed from a sheet having an average population of such apertures of about 8 per square inch.

What is claimed is:

1. A bag construction comprising:

(a) first and second, opposed, panel sections;

(i) each of said panel sections having a first end edge, a second end edge and opposite side edge portions extending between said first and second end edges;

(ii) said panel sections being secured to one another along at least a portion of said panel section side edge portions, to define a bag construction interior and opposite side edges;

(b) a base gusset member;

(i) said base gusset member being oriented in extension between said first and second panel sections, across an end of said bag construction interior;

(ii) said base gusset member including distribution apertures therein;

(c) a first transverse seal oriented to seal said first and second panel sections to one another; said first transverse seal being positioned to extend transversely across said bag construction at a location between said base gusset member and said first end edges of said first and second panel sections;

(d) a first transverse openable and reclosable closure arrangement extending between said first and second panel sections; said first transverse openable and reclosable closure arrangement being positioned to selectively seal said first panel section to said second panel section along a closure line oriented between said base gusset member and said second end edges of said first and second panel sections; and (e) a transverse openable and reclosable top closure arrangement extending between said first and second panel sections; said top closure arrangement being positioned to selectively seal said first panel section to said second panel section along a closure line oriented between said base Gusset member and first end edges of said first and second panel sections.

2. A bag construction according to claim 1 wherein:

(a) said base gusset distribution apertures comprise holes having an average diameter of about 0.1865 inch; said base gusset member comprising material having an average of 8 holes per square inch.

3. A bag construction according to claim 1 wherein:

(a) said first transverse openable and reclosable closure arrangement comprises a rib-and-trough closure arrangement.

4. A bag construction according to claim 1 including:

(a) a transverse end seal sealing said first and second panel sections to one another and extending along said second end edges of said first and second panel sections.

5. A bag construction according to claim 4 including:

(a) a weakened, transverse tear line extending across said bag construction and positioned between said first transverse openable and reclosable closure arrangement and said transverse end seal.

6. A bag construction according to claim 5 wherein:

(a) said transverse tear line is a score line in at least one of said panel sections.

7. A bag construction according to claim 5 wherein:

(a) said transverse tear line is a perforated tear line in at least one of said panel sections.

8. A bag construction according to claim 5 including:

(a) a first tear notch aligned with said transverse tear line and oriented in a first of said bag construction side edges; and (b) a second tear notch aligned with said transverse tear line and oriented in a second of said bag construction side edges.

9. A bag construction according to claim 1 including:

(a) flowable particulate material positioned in said bag construction interior and located, at least in part, between said base gusset member and said first end edges of said first and second panel sections;

(i) said flowable particulate material having a maximum average dimension that is sufficiently smaller than an average size of said distribution apertures in said base gusset member, so that said flowable particulate material can be readily, selectively, distributed through said base gusset member.

10. A bag construction according to claim 1 including:

(a) at least one handle aperture positioned to extend through said first and second panel sections at a location oriented between said top closure arrangement and said first end edges of said first and second panel sections.

11. A bag construction according to claim 1, wherein:

(a) said top closure arrangement comprises a rib-and-trough closure arrangement.

12. A bag construction comprising:

(a) first and second, opposed, panel sections;

(i) each of said panel sections having a first end edge, a second end edge, opposite side edge portions extending between said first and second end edges, and inner and outer wall sections;

(ii) said panel sections being secured to one another along at least a portion of said panel section side edge portions, to define a bag construction interior and opposite side edges;

(b) a base gusset member;

(i) said base gusset member being oriented in extension between said first and second panel sections, across an end of said bag construction interior;

(ii) said base gusset member being attached to said first and second panel sections along first and second attachment portions; said first attachment portions being along said panel section side edge portions; and said second attachment portions being along said panel section inner wall sections;

(iii) said base gusset member including distribution apertures therein;

(iv) said base gusset member being constructed of a flexible material; and (v) said base gusset member including a fold line extending: at least partially between said panel section side edge portions; and, between said second attachment portions and said panel section first end edges, when said bag construction is in a collapsed position;

(c) said first panel section and said second panel section being movable in a region between said base gusset member and said second end edges of said first and second panel sections; said first and second panel sections being movable whereby said fold line is at least partially unfolded and said base gusset member is exposable; and (d) a transverse openable and reclosable top closure arrangement extending between said first and second panel sections; said top closure arrangement being positioned to selectively seal said first panel section to said second panel section along a closure line oriented between said base gusset member and first end edges of said first and second panel sections;

(i) said fold line of said base gusset member being positioned between said top closure arrangement and said second attachment portions, when said bag construction is in a collapsed position.

13. A bag construction according to claim 12, further including:

(a) at least one handle aperture positioned to extend through said first and second panel sections at a location oriented between said top closure arrangement and said first end edges of said first and second panel sections.

14. A bag construction according to claim 12, further including:

(a) a transverse openable and reclosable bottom closure arrangement extending between said first and second panel sections; said bottom closure arrangement being positioned to selectively seal said first panel section to said second panel section along a closure line oriented between said base gusset member and said second end edges of said first and second panel sections.

15. A bag construction according to claim 14, wherein:

(a) said bottom closure arrangement comprises a rib-and-trough closure arrangement.

16. A bag construction according to claim 12, wherein:

(a) said top closure arrangement comprises a rib-and-trough closure arrangement.

17. A bag construction comprising:

(a) first and second, opposed, panel sections;

(i) each of said panel sections having a first end edge, a second end edge, opposite side edge portions extending between said first and second end edges, and inner and outer wall sections;

(ii) said panel sections being secured to one another along at least a portion of said panel section side edge portions, to define a bag construction interior and opposite side edges;

(b) a base gusset member;

(i) said base gusset member being oriented in extension between said first and second panel sections, across an end of said bag construction interior;

(ii) said base gusset member being attached to said first and second panel sections along first and second attachment portions; said first attachment portions being along said panel section side edge portions; and said second attachment portions being along said panel section inner wall sections;

(iii) said base gusset member including distribution apertures therein;

(iv) said base gusset member being constructed of a flexible material; and (v) said base gusset member including a fold line extending: at least partially between said panel section side edge portions; and, between said second attachment portions and said panel section first end edges, when said bag construction is in a collapsed position;

(c) a first transverse seal oriented to seal said first and second panel sections to one another; said first transverse seal being positioned to extend transversely across said bag construction at a location between said base gusset member and said first end edges of said first and second panel sections;

(d) a first transverse openable and reclosable closure arrangement extending between said first and second panel sections; said first transverse openable and reclosable closure arrangement being positioned to selectively seal said first panel section to said second panel section along a closure line oriented between said base gusset member and said second end edges of said first and second panel sections;

(i) said first transverse openable and reclosable closure arrangement comprising a rib-and-trough closure arrangement;

(e) a second transverse end seal sealing said first and second panel sections to one another and extending along said second end edges of said first and second panel sections;

(f) a weakened, transverse tear line extending across said bag construction and positioned between said first transverse openable and reclosable closure arrangement and said second transverse end seal;

(g) a first tear notch aligned with said transverse tear line and oriented in a first of said bag construction side edges;

(h) a second tear notch aligned with said transverse tear line and oriented in a second of said bag construction side edges; and (i) at least one handle aperture positioned to extend through said first and second panel sections at a location oriented between said first transverse seal and said first end edges of said first and second panel sections.

18. A bag construction according to claim 17, further including:

(a) a transverse openable and reclosable top closure arrangement extending between said first and second panel sections; said top closure arrangement being positioned to selectively seal said first panel section to said second panel section along a closure line oriented between said base gusset member and first end edges of said first and second panel sections.

19. A bag construction according to claim 18, wherein:

(a) said top closure arrangement comprises a rib-and-trough closure arrangement.

20. A bag construction according to claim 17, further including:

(a) flowable particulate material positioned in said bag construction interior and located, at least in part, between said base gusset member and said first end edges of said first and second panel sections.

* * * * *